US012031255B2

(12) United States Patent
Vaive

(10) Patent No.: US 12,031,255 B2
(45) Date of Patent: Jul. 9, 2024

(54) FRONT LOAD ALL-IN-ONE WASHER/DRYER COMBO REVERSE AIRFLOW SYSTEM

(71) Applicant: Whirlpool Corporation, Benton Harbor, MI (US)

(72) Inventor: Nicholas Vaive, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 299 days.

(21) Appl. No.: 17/509,198

(22) Filed: Oct. 25, 2021

(65) Prior Publication Data

US 2023/0130918 A1 Apr. 27, 2023

(51) Int. Cl.

| | |
|---|---|
| ***D06F 29/00*** | (2006.01) |
| ***D06F 58/04*** | (2006.01) |
| ***D06F 58/22*** | (2006.01) |
| ***D06F 58/26*** | (2006.01) |

(52) U.S. Cl.

CPC ..... *D06F 29/005* (2013.01); *D06F 58/04* (2013.01); *D06F 58/22* (2013.01); *D06F 58/26* (2013.01)

(58) Field of Classification Search

CPC ..... D06F 29/005

See application file for complete search history.

(56) References Cited

U.S. PATENT DOCUMENTS

| | | | |
|---|---|---|---|
| 8,997,377 | B2 | 4/2015 | Kim et al. |
| 10,526,745 | B2 | 1/2020 | Dunn et al. |
| 10,590,588 | B2 | 3/2020 | Kim et al. |
| 2011/0277513 | A1 | 11/2011 | Oak et al. |
| 2020/0270793 | A1 | 8/2020 | Kim et al. |
| 2020/0370235 | A1 | 11/2020 | Kang et al. |
| 2021/0095411 | A1 | 4/2021 | Rios Acebal |

FOREIGN PATENT DOCUMENTS

| | | | | |
|---|---|---|---|---|
| CN | 109234992 | A | | 1/2019 |
| DE | 102014219457 | A1 | | 3/2016 |
| DE | 102016214980 | | | 2/2018 |
| EP | 1022373 | A2 | | 7/2000 |
| EP | 2039825 | A1 | | 3/2009 |
| EP | 2746455 | A1 | | 6/2014 |
| EP | 3141655 | | | 3/2017 |
| JP | 200782831 | A | * | 4/2004 |
| JP | 2007082831 | A | | 4/2007 |
| JP | 5056821 | B2 | | 10/2012 |
| WO | WO-2019/192879 | A1 | | 10/2019 |

OTHER PUBLICATIONS

JP200782831A, English machine translation (Year: 2004).*

European Search Report for European Application No. 22196983.5-1016, dated Mar. 20, 2023 (90 Pages).

* cited by examiner

*Primary Examiner* — Jason Y Ko

(74) *Attorney, Agent, or Firm* — Harness, Dickey & Pierce, PLC

(57) ABSTRACT

A combination washer/dryer including a tub. A heating circuit is positioned adjacent the tub. The heating circuit draws in drying air from adjacent the front end of the tub. The heating circuit has a duct system. The duct system moves drying air from an area adjacent the front of the tub to a rear end of the tub to enable the drying air to enter a rear end of a drum.

20 Claims, 2 Drawing Sheets

FRONT LOAD ALL-IN-ONE WASHER/DRYER COMBO REVERSE AIRFLOW SYSTEM

FIELD

The present disclosure relates to household appliances and, more particularly, to a combination washer/dryer with a reverse drying circuit.

BACKGROUND

In current combination washers/dryers, the drying air is moved from the rear of the tub towards the front of the tub and into the front of the drum to dry the load. Thus, the airflow systems pull air from a condenser attached to the rear of the tub and direct the airflow through the bellows and into the load at the front of the drum. This prohibits a lint filter design that is consumer accessible for routine maintenance, much like a traditional dryer. In addition, it makes servicing of the lint filter or condenser extremely difficult, if not impossible. Accordingly, it would be desirable to have a combination washer/dryer that overcomes the deficiencies of the prior art.

Accordingly, the present disclosure provides the art with a washer/dryer combination that overcomes the deficiencies of the prior art. The present disclosure provides a combination washer/dryer that includes a drying air system that pulls from the bellows or door glass and pushes it into the load via the back of the tub and, in turn, the drum. In this way, the airflow is similar to that of a traditional dryer. That is, a lint filter can be positioned in front of the machine accessible to the user. Thus, air flow is, in turn, pushed into the clothes load through apertures in the rear panel of the drum.

SUMMARY

According to a first aspect of the disclosure, a combination washer/dryer combination comprises a tub and a heating circuit positioned adjacent the tub. The heating circuit draws in drying air from adjacent a front end of the tub. A duct system of the heating circuit moves the drying air to a rear end of the tub. This enables the drying air to enter into a rear end of the drum and ultimately into a clothes load to dry the load. The heating circuit includes a blower, a heater and duct system with an adapter enabling the duct system to couple with the tub. A lint filter is coupled with the heating circuit and positioned adjacent the front of the tub. A drum is rotatably positioned within the tub. The blower pulls in air into the combination washer/dryer at the front of the tub. The user has access to the lint filter at the front of the tub. A drying air flow path is in a reverse direction with respect to prior combination washers/dryers.

Accordingly to a second aspect of the disclosure, the combination washer/dryer comprises a cabinet including a door enabling access inside the cabinet. A drum and tub combination is positioned inside of the cabinet. A heating circuit is positioned adjacent the tub. The heating circuit draws in drying air from adjacent a front end of the tub. A duct system of the heating circuit moves the drying air to a rear end of the tub. This enables the drying air to enter into a rear end of the drum and ultimately into a clothes load to dry the load. The heating circuit includes a blower, a heater and duct system with an adapter enabling the duct system to couple with the tub. A lint filter is coupled with the heating circuit and positioned adjacent the front of the tub. A drum is rotatably positioned within the tub. The blower pulls in air into the combination washer/dryer at the front of the tub. The user has access to the lint filter at the front of the tub. A drying air flow path is in a reverse direction with respect to prior combination washers/dryers. The blower draws air from adjacent the door. The blower draws air into the lint filter through the duct system into the tub and exits through apertures in a rear panel of the drum. The drying air is pushed into a load as like a conventional dryer.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
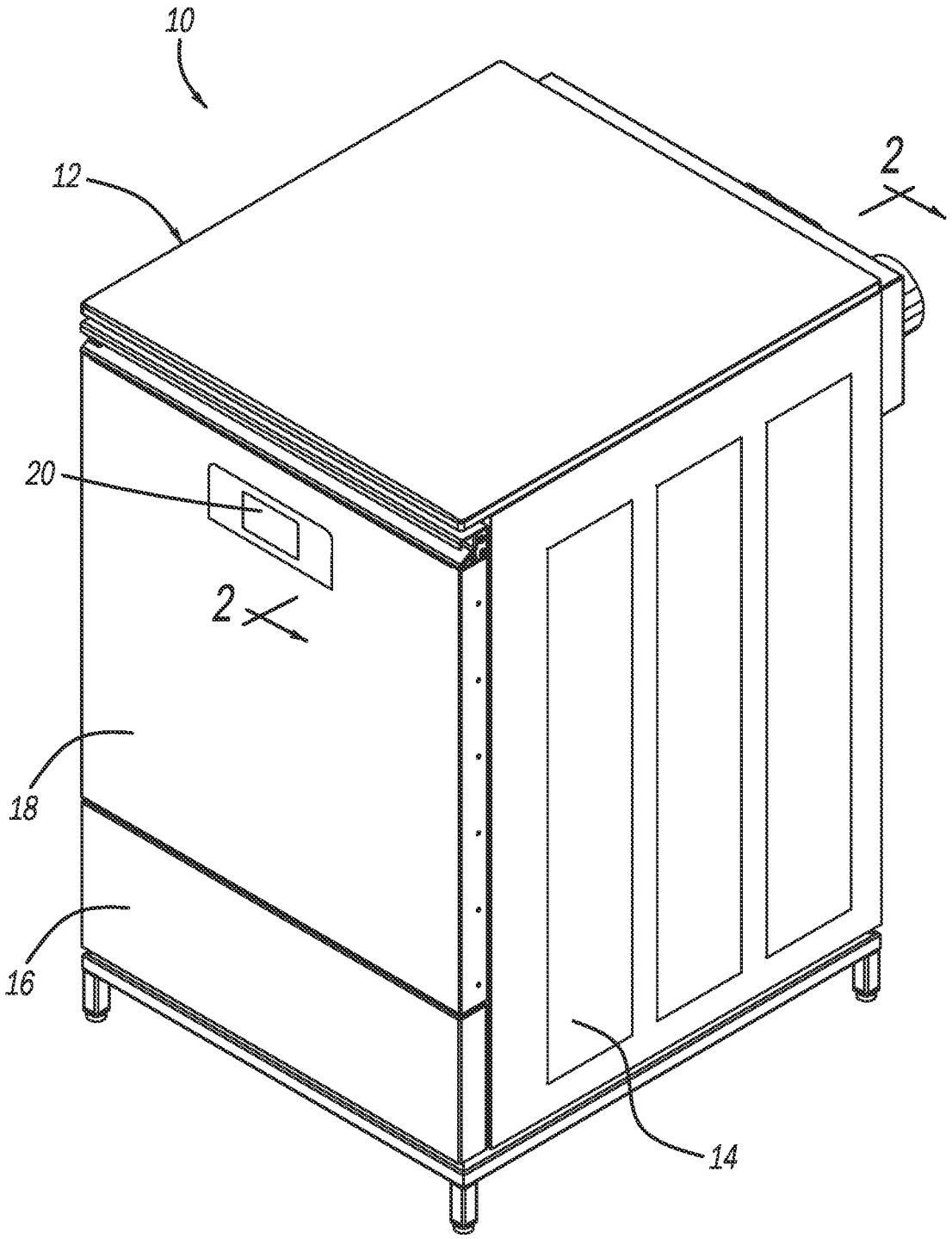
FIG. 1 is a perspective view of a combination washer/dryer.

Example embodiments will now be described more fully with reference to the accompanying drawings.

Turning to the figures, a combination washer/dryer is illustrated and designated with the reference numeral 10. The combination washer/dryer 10 includes a cabinet 12 with a plurality of panels 14, 16. Front panel 16 includes a door 18 to enable access into the combination washer/dryer 10. Controls 20 are positioned on the front panel 16. The controls 20 controls the operation of the combination washer/dryer 10.

Figure 2:
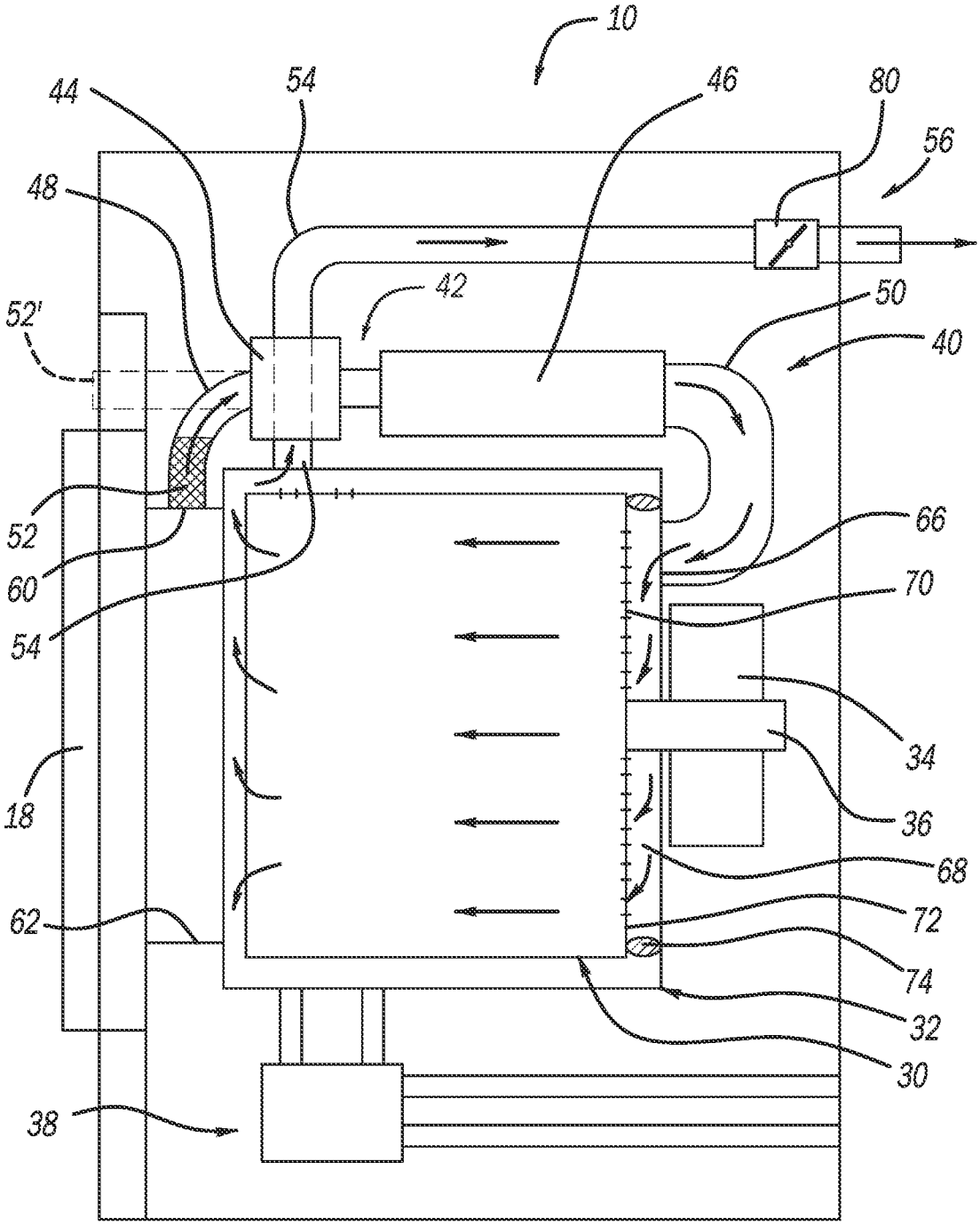
FIG. 2 is a schematic cross-section view of the washer/dryer of FIG. 1.

Turning to FIG. 2, a cross-section of the combination washer/dryer 10 is schematically illustrated. The combination washer/dryer 10 includes a drum 30 rotationally positioned within a tub 32. The drum 30 is rotated, via a motor 34, and a shaft 36. A washing circuit 38 is connected to the tub 32 and configured to provides water for washing of clothes within the drum 30 and tub 32. A heating circuit 40 (i.e., heating system) is configured to provides heat for drying the clothes within the drum 30.

The heating circuit 40 includes a duct system 42, a blower 44, and a heater 46. The duct system 42 includes first and second conduits 48, 50 as well as a lint trap 52. The duct system 42 also includes an exit conduit 54 connected with an outlet 56. The first conduit 48 includes an inlet 60. The inlet 60 is positioned in or adjacent to the door 18 or a bellows 62 positioned between the cabinet 12 and a front end of the tub 32. Thus, drying air is drawn into the heating circuit 40, via the inlet 60, near or adjacent the bellows 62 or door 18. A lint trap 52 may be positioned into the first conduit 48. Alternatively, a lint trap 52, could be positioned along the front panel 16 and be able to be withdrawn from the first conduit 48 and from the front panel 16.

The blower 44 is positioned in connection with the first conduit 48. The blower 44 draws air from the inlet 60 around the bellows 62 or door 18, which are located in an area at the front end of the cabinet 12 and tub 32. The air is drawn into the first conduit 48, via the blower 44, and passed from the blower 44 into the heater 46. The air is heated and passes out through the second conduit 50 that is in contact and connected with an outlet 66 in the tub 32. The outlet 66 in the tub 32 enables the heated drying air to pass into the tub 32 into a gap 68 between the tub 32 and the drum 30. The heated drying air then passes through apertures 70 in rear drum panel 72 into the drum 30. The air continues to circulate and may be drawn into the inlet 60 and pass through the heater 46 to recirculate and dry the load. The exit conduit 54 enables air to pass through the cabinet 12 to ambient. A damper 80 or the like can be positioned in the exit conduit 54 to control the amount of air exiting the tub 32 during the drying process.

In operation, the heating circuit 40 is initiated. Air is drawn in through the inlet 60 by the blower 44. The drawn in air is passed through the first conduit 48, the lint trap 52, the blower 44, and then into the heater 46. The air is heated by the heater 46 and is passed into the second conduit 50 that is connected with the outlet 66 in the tub 32. The air passes into the gap 68 between the drum 30 and tub 32. The apertures 70 in the rear drum panel 72 enable the air to pass into the drum 30 like in a conventional dryer. Thus, the air is pulled from an area at the bellows 62 or door 18 and is pushed into the load, via the rear drum panel 72 of the drum 30.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A combination washer/dryer comprising:

a cabinet;

a tub positioned within the cabinet;

a drum rotationally positioned within the tub;

a washing circuit connected to the tub and configured to provide water for washing clothes within the drum;

a heating circuit positioned in the cabinet adjacent the tub, the heating circuit including a duct system, a blower, and a heater, the blower and the heater are arranged along and coupled to the duct system of the heating circuit such that drying air is drawn into the duct system through an inlet that is positioned near a front end of the tub, is passed from the blower to the heater, and passes out of the duct system through an outlet at a rear end of the tub to enable the drying air to enter a rear end of a drum to form a drying air recirculation flow path; and an exit conduit that extends between the tub and an exhaust outlet through which the drying air passes through the cabinet to ambient.

2. The combination washer/dryer of claim 1, wherein the duct system includes a first conduit positioned between and coupled to the inlet and the blower.

3. The combination washer/dryer of claim 2, wherein the duct system includes an adapter enabling the first conduit to couple with the tub at the inlet.

4. The combination washer/dryer of claim 2, wherein a lint filter is coupled with the heating circuit adjacent the front of the tub.

5. The combination washer/dryer of claim 4, wherein the lint filter is positioned within at least a portion of the first conduit.

6. The combination washer/dryer of claim 2, wherein the duct system includes a second conduit positioned between and coupled to the heater and the outlet at the rear end of the tub such that the blower pulls the drying air into the first conduit at the front end of the tub and passes the drying air through the heater and then the second conduit to the outlet, where the drying air exits the second conduit and enters a gap between the rear end of the tub and the rear end of the drum.

7. The combination washer/dryer of claim 4, wherein a user has access to the lint filter at the front end of the tub.

8. The combination washer/dryer of claim 1, wherein the drying air recirculation flow path through the heating circuit is in a reverse direction moving from the front end of the tub to the rear end of the tub.

9. A combination washer/dryer comprising:

a cabinet including a front panel with a door enabling access inside the cabinet;

a tub positioned inside of the cabinet;

a drum rotationally positioned within the tub;

a heating circuit positioned in the cabinet adjacent the tub, the heating circuit including a duct system, a blower, and a heater, the blower and the heater are arranged along and coupled to the duct system of the heating circuit such that drying air is drawn into the duct system from an area inside the cabinet adjacent the door on the front panel of the cabinet, is passed from the blower to the heater, and passes out of the duct system through an outlet at a rear end of the tub to enable the drying air to enter a rear end of the drum to form a drying air recirculation flow path; and an exit conduit that extends between the tub and an exhaust outlet through which the drying air passes through the cabinet to ambient.

10. The combination washer/dryer of claim 9, wherein the duct system includes a first conduit positioned between and coupled to the inlet and the blower.

11. The combination washer/dryer of claim 10, wherein the duct system includes an adapter enabling the first conduit to couple with the tub at the inlet.

12. The combination washer/dryer of claim 10, wherein a lint filter is coupled with the heating circuit adjacent the front panel of the cabinet.

13. The combination washer/dryer of claim 12, wherein the lint filter is positioned within at least a portion of the first conduit.

14. The combination washer/dryer of claim 12, wherein a user has access to the lint filter at the front panel of cabinet.

15. The combination washer/dryer of claim 9, wherein the drying air recirculation flow path through the heating circuit is in a reverse direction moving from the area inside the cabinet adjacent the door on the front panel of the cabinet to the rear end of the tub.

16. The combination washer/dryer of claim 10, wherein the duct system includes a second conduit positioned between and coupled to the heater and the outlet at the rear end of the tub such that the blower draws the drying air into the first conduit from the area inside the cabinet adjacent the door on the front panel of the cabinet and passes the drying air to the heater and then the second conduit and to the outlet, where the drying air exits the second conduit and enters a gap between the tub and the drum.

17. The combination washer/dryer of claim 10, wherein the drying air exiting the duct system through the outlet at the rear end of the tub flows into the drum through apertures in the rear end of the drum.

18. The combination washer/dryer of claim 17, wherein the drying air flows through the drum from the rear end of the drum to the area inside the cabinet adjacent the door in the front panel of the cabinet.

19. The combination washer/dryer of claim 9, further comprising a damper positioned in fluid communication with the exit conduit to control an amount of air exiting the exhaust outlet of the exit conduit.

20. The combination washer/dryer of claim 1, further comprising a damper positioned in the exit conduit to control an amount of air exiting the exit conduit.

* * * * *